US008191388B2

(12) United States Patent
Kim et al.

(10) Patent No.: US 8,191,388 B2
(45) Date of Patent: Jun. 5, 2012

(54) DRYING DUCT ASSEMBLY AND WASHING MACHINE HAVING THE SAME

(75) Inventors: Myoung-Deok Kim, Kimhae-si (KR); Dong-Woo Kang, Changwon-si (KR); Su-Hee Shin, Busan-si (KR); Hyon-Su Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 866 days.

(21) Appl. No.: 12/064,171

(22) PCT Filed: Aug. 17, 2006

(86) PCT No.: PCT/KR2006/003215

§ 371 (c)(1),
(2), (4) Date: Feb. 19, 2008

(87) PCT Pub. No.: WO2007/021134

PCT Pub. Date: Feb. 22, 2007

(65) Prior Publication Data

US 2008/0244922 A1 Oct. 9, 2008

(30) Foreign Application Priority Data

Aug. 19, 2005 (KR) ..... 10-2005-0076073
Aug. 19, 2005 (KR) ..... 10-2005-0076074
Aug. 19, 2005 (KR) ..... 10-2005-0076075
Aug. 19, 2005 (KR) ..... 10-2005-0076076
Aug. 19, 2005 (KR) ..... 10-2005-0076077

(51) Int. Cl.
*D06F 39/04* (2006.01)
*D06F 58/26* (2006.01)

(52) U.S. Cl. ..... 68/20; 34/138

(58) Field of Classification Search ..... 68/19.2, 68/20; 34/77, 132, 138, 607
See application file for complete search history.

(56) References Cited

U.S. PATENT DOCUMENTS 3,799,387 A * 3/1974 Zenz ..... 220/476
5,560,120 A * 10/1996 Swanson et al. ..... 34/82
7,644,516 B2 * 1/2010 Chung ..... 34/604
2004/0103697 A1 * 6/2004 Kim et al. ..... 68/18 R
2005/0217138 A1 * 10/2005 Kohne et al. ..... 34/603
2005/0235519 A1 * 10/2005 Chung ..... 34/607
2006/0005582 A1 * 1/2006 Lee et al. ..... 68/5 R (Continued)

FOREIGN PATENT DOCUMENTS

DE 41 04 760 A1 8/1992

(Continued)

OTHER PUBLICATIONS

Taiwanese Office Action dated Oct. 25, 2010 issued in Application No. 095130505.

(Continued)

*Primary Examiner* — Joseph L Perrin
(74) *Attorney, Agent, or Firm* — KED & Associates, LLP

(57) ABSTRACT

There are provided a drying duct assembly and a washing machine having the drying duct assembly. The drying duct assembly includes a duct lower, a duct upper coupled to an upper portion of the duct lower, a reflector seating on one of inner circumferences of the duct lower and the duct upper, a heater provided in the duct lower to generate heat, and a fan assembly provided on a side of the duct lower to suck air.

41 Claims, 6 Drawing Sheets

U.S. PATENT DOCUMENTS

| | | | | |
|---|---|---|---|---|
| 2006/0016092 | A1* | 1/2006 | Kim et al. | 34/130 |

FOREIGN PATENT DOCUMENTS

| | | | |
|---|---|---|---|
| EP | 0 942 093 | A1 | 9/1999 |
| EP | 1538255 | | 6/2005 |
| EP | 1614792 | | 1/2006 |
| JP | 2005058658 | | 3/2005 |
| RU | 95117707 | | 9/1997 |
| RU | 2 144 103 | C1 | 1/2000 |

OTHER PUBLICATIONS

Taiwanese Office Action dated Jan. 5, 2009.

Actpoh-Group—"Vakuumformovochnye Machines (Vakuumformovschiki)"; Information printed from http://ww.astronc.ru/pw-vacuumform.html.

Russian Office Action dated Sep. 21, 2010 issued in Application No. 2008110500/12.

Russian Office Action dated Dec. 24, 2010 (with translation).

* cited by examiner

[Fig. 1]
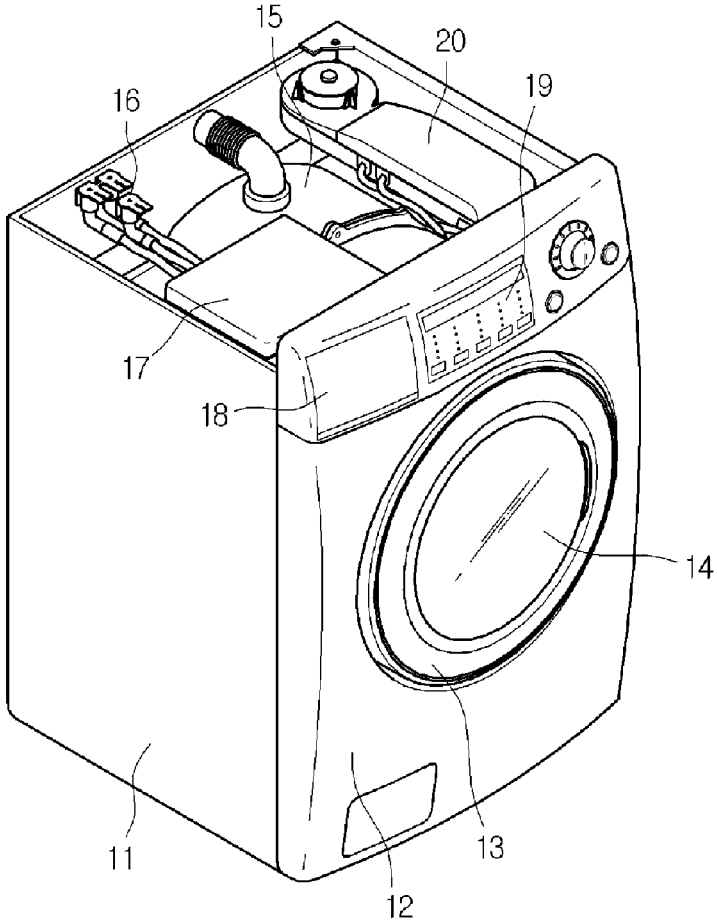
[Fig. 2]
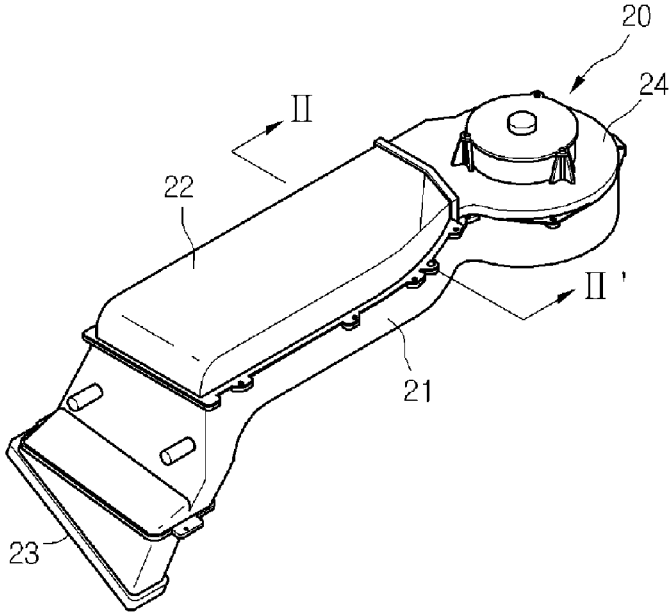

[Fig. 3]
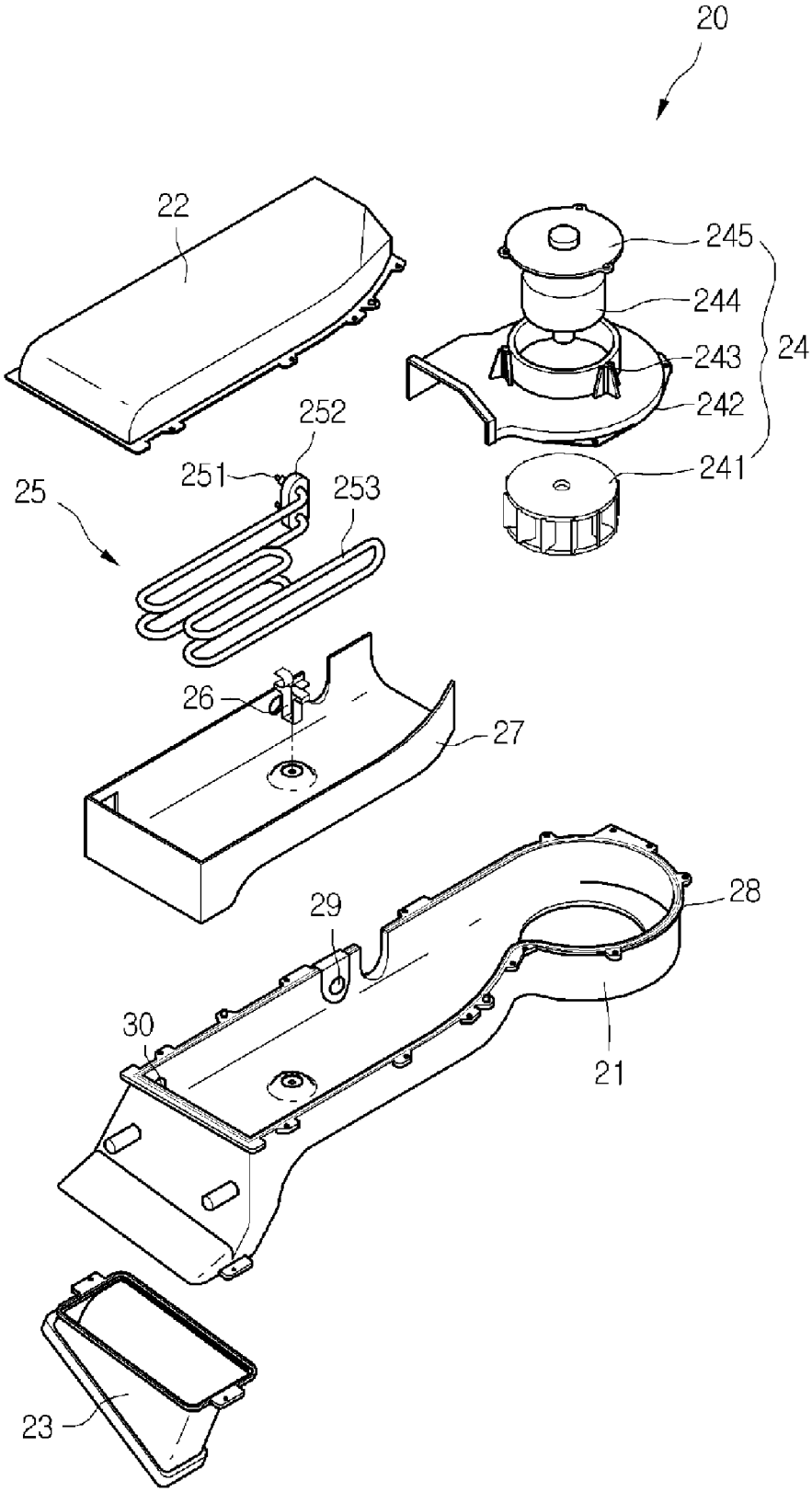

[Fig. 4]
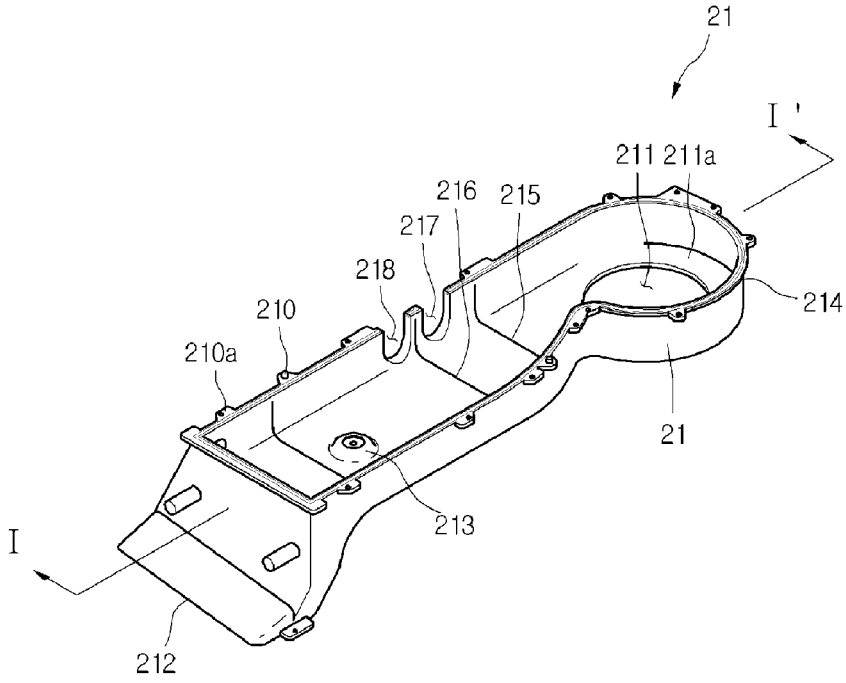
[Fig. 5]
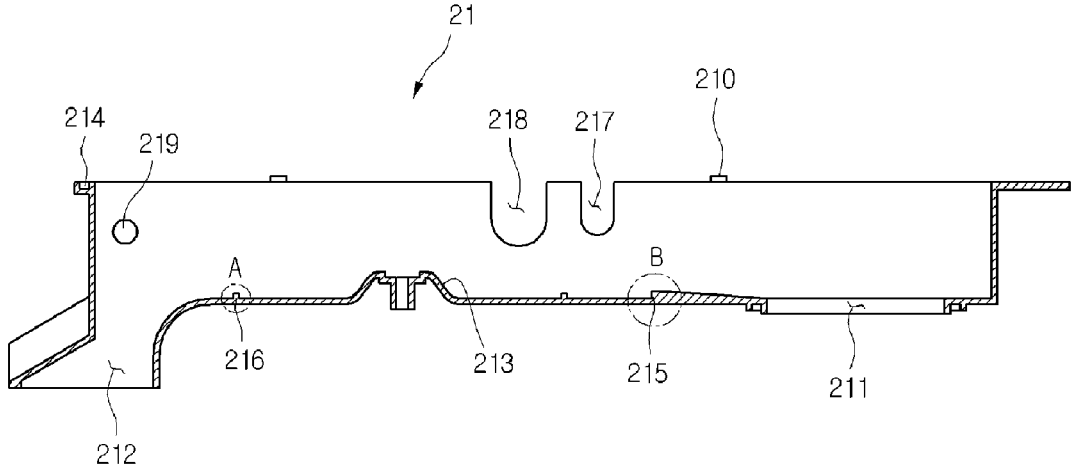
[Fig. 6]
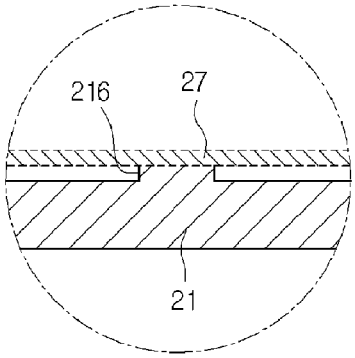

[Fig. 7]
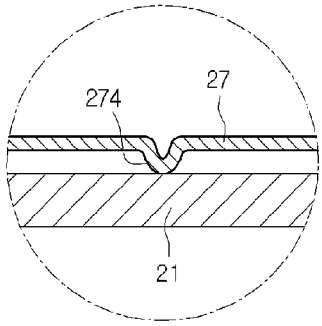
[Fig. 8]
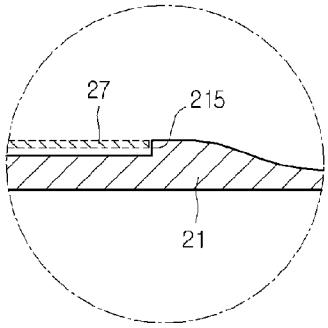
[Fig. 9]
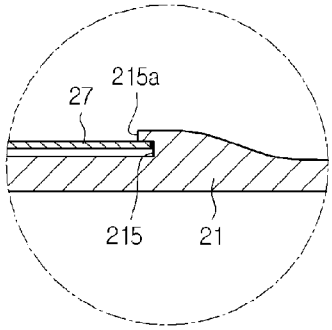
[Fig. 10]
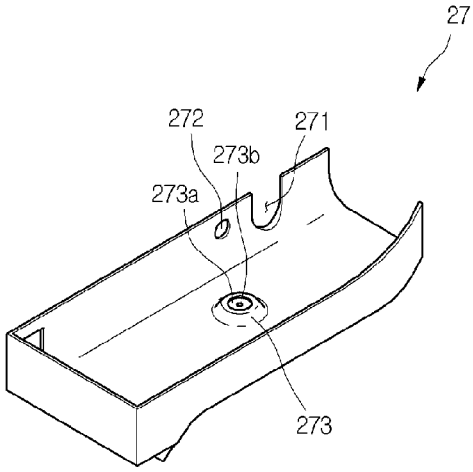

[Fig. 11]
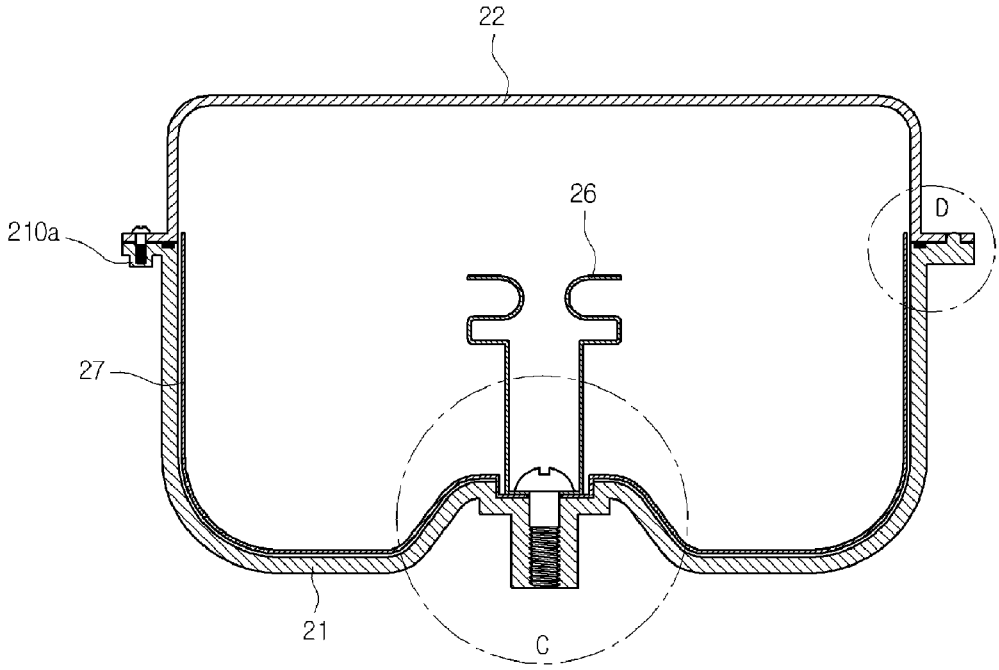
[Fig. 12]
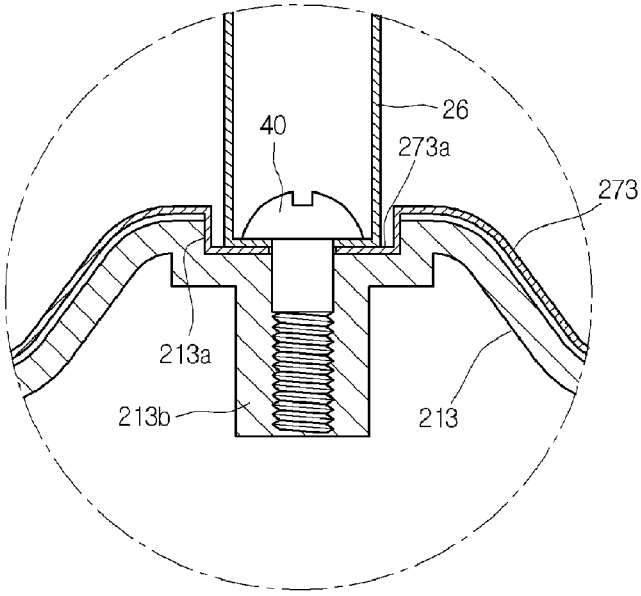
[Fig. 13]
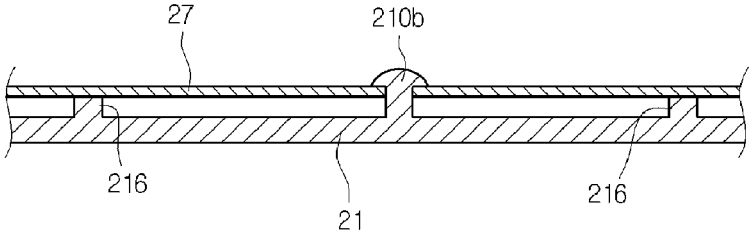

[Fig. 14]
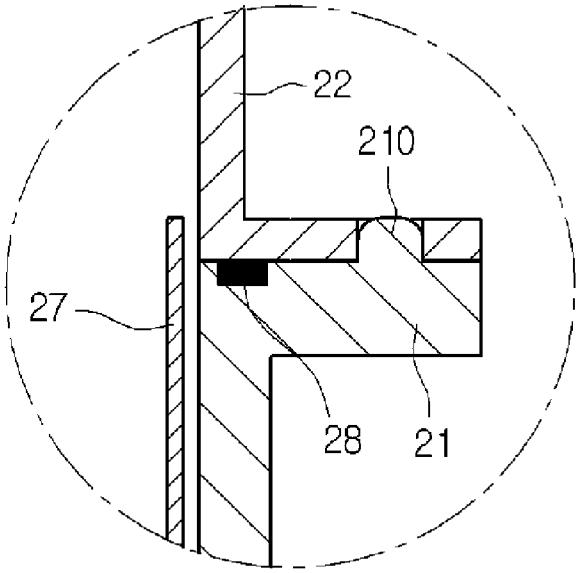

DRYING DUCT ASSEMBLY AND WASHING MACHINE HAVING THE SAME

TECHNICAL FIELD

The present invention relates to a drying duct assembly and a washing machine having the drying duct assembly.

BACKGROUND ART

Generally, a washing machine with a drying function is a home appliance that can wash and dry laundry.

The washing machine with the drying function is classified into an exhaust type in which air in the drum is exhausted to an external side during a drying process and a condensing type in which air in the drum is not exhausted but circulated in the washing machine.

The condensing type washing machine includes a drying duct provided on an upper portion of a tub and a heater installed in the drying duct. The heater heats air introduced into the drum to a high temperature. A condensing duct for connecting the drying duct to the tub enclosing the drum is provided to lower the temperature of the air exhausted from the drum. The air passing through the condensing duct is returned into the drying duct. The air is changed into a high temperature/dry state in the drying duct and directed into the drum. This circulation process is repeated.

Meanwhile, when electric power is applied to the heater installed in the drying duct, the heater generates heat above 700° C. and thus the air maintains a temperature of about 120° C.

Therefore, the drying duct is generally formed of metal material endurable the high temperature. For example, the drying duct is formed of aluminum through a die-casting process.

However, when the drying duct is formed of the aluminum through the die-casting process, the manufacturing cost increases and an overall weight of the drum-type washing machine increases.

Furthermore, since a cabinet on which front and rear surfaces of the drying duct are supported requires a rigidity enough to endure the load of the drying duct. This also cases the increase of the manufacturing cost of the washing machine.

In addition, when the drying duct is formed of the aluminum through the die-casting process, a thickness of the drying duct increases and thus an overall volume of the washing machine increases or an internal space of the drying duct is reduced.

DISCLOSURE OF INVENTION

Technical Problem

Accordingly, the present invention is directed to a drying duct assembly and a washing machine having the drying duct assembly that substantially obviate one or more problems due to limitations and disadvantages of the related art.

An object of the present invention is to provide a drying duct assembly that is formed of a lightweight material endurable the high temperature and a washing machine having the drying duct assembly.

Another object of the present invention is to provide a drying duct assembly that can be inexpensively manufactured and increases an internal volume thereof and a washing machine having the drying duct assembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Technical Solution

To achieve these objects and other advantages and in accordance with the purpose of the invention, as embodied and broadly described herein, there is provided a drying duct assembly including: a duct lower; a duct upper coupled to an upper portion of the duct lower; a reflector seating on one of inner circumferences of the duct lower and the duct upper; a heater provided in the duct lower to generate heat; and a fan assembly provided on a side of the duct lower to suck air.

In another aspect of the present invention, there is provided a drying duct assembly including: a duct lower; a duct upper coupled to an upper portion of the duct lower to define an air passage; a reflector seating on one of inner circumferences of the duct lower and duct upper; a heater for heating air introduced into the air passage; a fan assembly provided on a fan seating portion to intake the air; and a duct connector connected to one of the duct lower and duct upper to direct the air sucked by the fan assembly into a drum.

In still another aspect of the present invention, there is provided a drying duct assembly including: a duct lower around which a sealing member is installed and which is formed of plastic or SPS; an duct upper covering an upper portion of the duct lower; a reflector formed of metal and seating on an inner circumference of the duct lower; and a heater provided in a space defined between the duct lower and the duct upper.

In still another aspect of the present invention, there is provided a drying duct assembly including: duct upper and duct lower that are formed of plastic or SPS; a heater disposed in a space defined between the duct upper and the duct lower; a reflector provided between a plastic or SPS portion of the duct lower and the heater; and a spacing unit spacing the reflector apart from the plastic or SPS portion.

In still yet another aspect of the present invention, there is provided a drying duct assembly including: a duct lower having a fan seating portion provided at a first end and a stepped portion formed on an inner circumference; a duct upper covering the duct lower to define an air passage; a reflector provided between the duct lower and the duct upper and having a first end contacting the stepped portion; and a fan assembly seating on the fan seating portion.

In still yet another aspect of the present invention, there is provided a washing machine including: a drum in which laundry is loaded; a tub receiving the drum; a drying duct assembly provided on an outer side of the tube to supply hot wind into the drum; and a condensing duct connected to the tub, damp air exhausted from the tub flowing along the condensing duct, wherein the drying duct assembly includes: duct upper and duct lower that are formed of plastic or SPS; a heater disposed in a space defined between the duct upper and the duct lower; a reflector provided between a plastic or SPS portion of the duct lower and the heater, the reflector being formed of metal; a spacing unit spacing the reflector apart from the plastic or SPS portion; and a fan assembly sucking outer air and directing the sucked air to the tub.

Advantageous Effects

According to the present invention, the weight of the drying duct can be reduced.

Since the drying duct assembly is formed of a high heat-resistance plastic material through an injection molding process, it is not easily deformed even at a high temperature, thereby preventing the fire from breaking out.

In addition, since the overall weight of the washing machine having the drying duct assembly is reduced, the delivery can be easily realized.

Furthermore, since the weight of the drying duct is reduced, the load applied to the cabinet supporting the drying duct is reduced. Therefore, the cabinet does not require the high strength material. Therefore, a material selection range for the cabinet can be widened.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a washing machine to which a drying duct assembly according to an embodiment of the present invention is applied;

FIG. 2 is a perspective view of a drying duct assembly according to an embodiment of the present invention;

FIG. 3 is an exploded perspective view of the drying duct assembly of FIG. 2;

FIG. 4 is a perspective view of a duct lower of the drying duct assembly of FIG. 2;

FIG. 5 is a sectional view taken along line I-I of FIG. 4;

FIG. 6 is an enlarged view of a portion A of FIG. 5;

FIG. 7 is a sectional view of a reflector spacing unit according to another embodiment of the present invention;

FIG. 8 is an enlarged view of a portion B of FIG. 5;

FIG. 9 is a sectional view of a nap introduction preventing unit according to another embodiment of the present invention;

FIG. 10 is a perspective view of a reflector according to an embodiment of the present invention;

FIG. 11 is a sectional view taken along line II-II of FIG. 2;

FIG. 12 is an enlarged view of a portion C of FIG. 11;

FIG. 13 is a view illustrating a coupling method of a reflector and a duct lower according to another embodiment of the present invention; and FIG. 14 is an enlarged view of a portion D of FIG. 11.

BEST MODE FOR CARRYING OUT THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

FIG. 1 is a perspective view of a washing machine to which a drying duct assembly according to an embodiment of the present invention is applied.

In the following description, a drum-type washing machine will be exampled.

Referring to FIG. 1, a washing machine 10 includes a cabinet 11, a front cover 12 mounted on a front portion of the cabinet 11, a door 13 pivotally mounted on a front-center portion of the front cover 12, a tub 15 mounted in the cabinet 11 to reserve washing water, and a drum 14 received in the tub 15. The laundry is loaded in the drum 14.

The washing machine 10 further includes a detergent box 18 inserted into the cabinet 11 through an upper portion of the front cover 12 to store detergent, softener and the like, a dispenser 17 for receiving the detergent box 18 and guiding the flow of the washing water, and a water supply valve 16 mounted on a rear surface of the cabinet 11 to supply the washing water. The water supply valve 16 and the dispenser 17 are interconnected by a water supply hose.

The washing machine 10 further includes a drying duct assembly 20 mounted on the upper portion of the tub 15 to supply hot-wind into the drum 14 during a drying process and a control panel 19 mounted on a front surface of the front cover 12 and having an input portion for inputting washing mode and a display portion for display a washing process.

The washing machine 10 further includes a condensing duct mounted in the cabinet 11. The condensing duct has a first end connected to the tub 15 and a second end connected to the drying duct assembly 20. A cooling water supply hose for supplying cooling water is connected to an upper portion of the condensing duct so that the cooling water falls from the condensing duct.

The operation of the washing machine will now be described.

After the door 13 is opened and the laundry is loaded in the drum 14, the detergent and/or softener is inputted in the detergent box 18. Then, the washing mode is set through the control panel 19 and the operation button is turned on. Then, electric power is applied to the washing machine 10 to perform washing, rinsing, spin-drying, and heat-drying processes according to the inputted washing mode.

Meanwhile, when the washing mode includes a heat-dry process, electric power is applied to heater mounted in the dry duct assembly after the spin-dry process is finished. Then, the drum 14 rotates at a relatively low RPM so allow the laundry is repeatedly lifted and falls down. At this point, a drying fan mounted in the drying duct assembly 20 operates to intake the air discharged toward the front portion of the drum 14. Then, the air in the drum 14 is introduced into the drying duct assembly 20 along the condensing duct and changed into a high temperature/dry state. The high temperature/dry air is directed into the drum 14 to absorb moisture of the laundry, thereby being changed into the high temperature/humidity damp air. The high temperature/humidity damp air is exhausted out of the drum 14 and moves upward along the condensing duct.

Here, cooling water falls from an upper portion of the condensing duct and heat-exchanges with the high temperature/humidity damp air is changed into a low temperature state while passing through the condensing duct. The moisture contained in the damp air is condensed and lows into the tub 15. The condensed water directed into the tub 15 flows to a drain pump mounted on a bottom of the tub 15. In addition, the damp air ascending along the condensing duct is changed into a low temperature/dry state. The air ascending along the condensing duct flows into the drying duct assembly 20 and is heated to a high temperature/dry state. Then, this air flows into the drum 14. This air circulation is repeated for a pre-set time period.

FIG. 2 is a perspective view of a drying duct assembly according to an embodiment of the present invention and FIG. 3 is an exploded perspective view of the drying duct assembly of FIG. 2.

Referring to FIGS. 2 and 3, the drying duct assembly 20 includes a duck lower 21, a duct upper 22 seating on an upper portion of the duct lower 21, a duct sealing 28 seating on an top-edge of the duck lower 21, a fan assembly 24 mounted on a first end of the duct lower 21, a duct connector 23 mounted on a second end of the duct lower 21 to connect the dry duct assembly 20 to the tub 15, a heater 25 mounted in the drying duct assembly 20 to generate high temperature heat, a reflector 27 mounted in the duct lower 21 and spaced apart from the duct lower 21, and a heat bracket 2 fixing the heater 25 such that the heater 25 is spaced apart from the duct lower 21.

The fan assembly 24 includes a drying fan 241 sucking the air in an axial direction and exhausting the air in a radial direction, a fan motor 244 disposed above the drying fan 241 to rotate the drying fan 241, an air guide 242 for guiding the flow of the air sucked by the drying fan 241, a motor housing 243 protruding upward from a top surface of the air guide 242 and receiving the fan motor 244, a motor mount 245 seating on a top surface of the motor housing 243 and supporting the fan motor 244.

An over-heating preventing sensor 29 is mounted on a side-central portion of the duct lower 21 to prevent the inside of the drying duct assembly 20 from being over-heated. A temperature sensor 30 is mounted on an end of the duct lower 21, where the duct connector 23 is mounted to detect the temperature of the air introduced into the tub 15. That is, the temperature sensor 30 detects the temperature of the air introduced into the tub 15 to maintain the temperature of the air at 120° C. The duct seal 28 prevents the high temperature air from leaking through a portion where the duct lower 21 contacts the duct upper 22.

In addition, the heater 25 includes a terminal portion 251 to which a current flow wire is connected, a heater seal 252 mounted at a place spaced apart from the terminal portion 251 to prevent the air leakage, and a heat generation portion 253 extending from the terminal portion 251 and having a predetermined diameter and length. The terminal portion 251 is bent at a plurality of portions. That is, the heater seal 252 is fitted on side surfaces of the reflector 27 and the duct lower 21 to prevent the air leakage. The heat generation portion 253 is a sheath heater with a heat wire.

Meanwhile, the duct lower 21 and the duct connector 23 contact the high temperature air. Therefore, they are formed of high temperature-resistant resin through an injection molding process so that they are not deformed or bunt.

Preferably, the duct lower 21 and the duct connector 23 may be formed of syndiotactic polystyrenes (SPS) disclosed in Korean Patent Application No. 10-2003-0075942 filed by LG Chem. LTD. That is, the SPS is produced by mixing styrene-based monomer and atactic polystyrenes with a catalytic material. The SPS has a high heat-resistance and a high chemical-resistance while enjoying the advantages of conventional styrene polymer, such as a low permittivity and a good heat fluidity.

Furthermore, the reflector 27 is attached along an upper-inner circumference of the duct lower 21. That is, the reflector 27 is formed of a metal plate on which aluminum is coated. The reflector 27 is designed to effectively endure the high temperature heat generated by the heater 25. Therefore, the duct lower 21 is formed of the SPS enduring the high temperature. As the reflector is mounted on the top portion of the duct lower 21, the deformation of the duct lower 21 by the high temperature heat generated from the heater can be further prevented.

Here, the duct upper 22 is also formed of the SPS and the reflector is also attached on the inner circumference of the duct upper 22. The air guide 242 is also formed of the SPS. However, since the air guide 242 does not directly receive the heat from the heater 25, it may be formed of a plastic material through the injection molding process.

Meanwhile, the reflector 27 is spaced apart from the top surface of the duct lower 21. That is, a thin air layer is formed between the reflector 27 and the duct lower 21 to prevent the heat transferred to the reflector 27 from being directly transferred to the duct lower 21.

In addition, a stepped portion having a predetermined height is formed on an inner circumference of the duct lower 21 where the fan assembly 24 is disposed to prevent foreign objects such as naps from being introduced into the air layer. This will be described in more detail later.

The function and operation of the drying duct assembly 20 will now be described hereinafter.

When the heat-drying process starts, electric power is applied to the fan motor 244 to rotate the drying fan 241 and the heater 25 is heated to a high temperature. Air is sucked into the drum 14 by the rotation of the drying fan 241. The sucked air flows along an air passage formed between the duck lower 21 and the duct upper 22 to heat-exchange with the heater 25. The air heated to the high temperature is introduced into the tub 15 through the duct connector 23. The air introduced into the dub 15 vaporizes the moisture contained in the laundry, thereby drying the laundry.

FIG. 4 is a perspective view of a duct lower of the drying duct assembly of FIG. 2.

Referring to FIG. 4, the duct lower 21 has a longitudinal section formed in a U-shape.

That is, the duct lower 21 is provided at an end portion with a fan seating portion 211*a* having a predetermined diameter. An air inlet 211 through which air is introduced is formed on the bottom of the fan seating portion 211*a*. The air passage is formed along a tangent direction of the fan seating portion 211*a*. The air passage has a width expanding from the tangent portion of the fan seating portion 211*a*. Therefore, the flow rate of the air discharged into the air passage while rotating the fan seating portion 211*a* is reduced to increase time for which the air heat-exchanges with the heater 25.

Meanwhile, the duct lower 21 is provided at a side surface with a heater seal seating groove 217 in which the heater seal 252 is inserted and an over-heating preventing sensor seating groove 218 in which the over-heating preventing sensor 29 is inserted. The duck seal 28 seats on an upper edge of the duct lower 29. The duct lower 21 is provided at a second end with an air outlet 212 through which the high temperature air is exhausted to the tub 15. The duct lower 21 is further provided at a side of the second end with a temperature sensor hole 219 in which the temperature sensor 30 is mounted (see FIG. 5).

In addition, the duct lower 21 is further provided at a side of the upper edge with a plurality of guide bosses 210 so that the duct upper 22 can be coupled to a right position. A coupling boss 210*a* extends downward from the guide boss 210. That is, the duct upper 22 seats on the top surface of the duct lower 21 and a coupling member is inserted in the coupling boss 210*a*.

A heater bracket supporting portion 213 protrudes from the bottom of the duct lower 21. That is, the heater bracket 26 seats on the upper portion of the heater bracket supporting portion 213. The heater 25 is supported by the heater bracket 26. The heater bracket supporting portion 213 will be described in more detail later.

In addition, the supporting rib 216 is continuously or discontinuously formed on the inner circumference of the duct lower 21 so that the reflector 27 can be spaced apart from the duct lower 21. A stepped portion 215 is formed at a portion spaced apart from the reflector 27. The supporting rib 216 and the stepped portion 215 will be described in more detail later.

By the above-described duct lower 21, the air introduced through the air inlet 211 is heated to the high temperature by the heater 25 and flows to the duct connector 23 through the air outlet 212. The air is then directed into the tub 15.

FIG. 5 is a sectional view taken along line I-I of FIG. 4 and FIG. 6 is an enlarged view of a portion A of FIG. 5.

Referring to FIGS. 5 and 6, a reflector spacing unit for spacing the reflector 27 from the duct lower 21 is provided. That is, the supporting rib 216 protruding from the inner bottom of the duct lower 21 by a predetermined height functions as the reflector spacing unit.

That is, the supporting rib 216 may be continuously formed along the side and bottom of the duct lower 21 or may be divided into a plurality of sections arranged at predetermined intervals. Alternatively, as the reflector spacing unit, a plurality of bosses each having a predetermined height may be formed on the inner circumference of the duct lower 21. The supporting rib 216 or the supporting bosses may be integrally formed with the duct lower 21 through the injection molding process.

FIG. 7 is a sectional view of a reflector spacing unit according to another embodiment of the present invention.

Referring to FIG. 7, in order to space the reflector 27 apart from the duct lower 21, the reflector 27 is provided with one or more forming portions 274.

That is, the reflector 27 is formed of a thin metal plate through a sheet metal working in the coursed of which a top surface of the reflector 27 is pressed down to be concaved by a predetermined depth. Then, the forming portion 274 line-contacts the duct lower 21 and thus the heat transfer from the reflector 27 to the duct lower 21 can be minimized.

FIG. 8 is an enlarged view of a portion B of FIG. 5.

Referring to FIG. 8, since the reflector 27 is spaced apart from the duct lower 21 by a predetermined distance, there is a need for a unit for preventing naps from being introduced through a gap between the reflector 27 and the duct lower 21. Therefore, in order to prevent the forming of a gap at an end of the reflector 27 close to the fan assembly 24, the duct lower 21 is provided with the stepped portion 215.

That is, the duct lower 21 is provided with a stepped portion that is stepped downward from the top surface and the end of the reflector 27 contacts the stepped portion 215. By this coupling structure, no nap is introduced through a gap between the duct lower 21 and the reflector 27. Furthermore, since the bottom surface of the reflector 27 and the bottom surface of the duct lower 21 are disposed on an identical plane, the air sucked by the drying fan 214 flows along the inside of the duct without receiving any flow-resistance.

FIG. 9 is a sectional view of a nap introduction preventing unit according to another embodiment of the present invention.

Referring to FIG. 9, there is shown a unit for preventing naps from being introduced through the gap between the reflector 27 and the duct lower 21 and preventing the end of the reflector 27 from being lifted.

That is, an extending portion 215*a* is formed on an upper portion of the stepped portion 215 depicted in FIG. 8. The end of the reflector 27 is inserted in a groove formed on a lower portion of the extending portion 215*a*. As a result, the lift or movement of the end of the reflector 27 can be suppressed by the extending portion 215*a*.

Here, since the extending portion 215*a* extends in a direction where the air sucked by the drying fan 241, no airflow resistance is generated.

FIG. 10 is a perspective view of a reflector according to an embodiment of the present invention.

Referring to FIG. 10, the reflector 27 is formed by cutting and bending a sheet metal working. The outer circumference of the reflector 27 is coated with aluminum to minimize the shape deformation at the high temperature. Here, the upper duct 22 may be formed of the same material as that of the reflector 27. In this case, no heat insulation member such as the reflector 27 is required.

The heater bracket supporting portion 273 is formed on the bottom of the reflector 27. The heater bracket supporting portion 273 is formed by striking the bottom upward.

The heater bracket supporting portion 273 is provided at the top surface with a concave portion 273*a* and the concave portion 273*a* is provided with a coupling hole 273*b* in which the coupling member is inserted. The lower end of the heater bracket 26 seats on the concave portion 273*a* not to move. This will be described in more detail later.

The reflector 27 is provided at the side surface with the heater seal seating portion 271 in which the heater seal 252 seats. The over-heating preventing sensor hole 272 in which the over-heating preventing sensor 29 seats is formed on the side surface of the reflector 27. The first end of the reflector 27 contacts the stepped portion 215 of the duct lower 21 and the second end is provided with an air outlet corresponding to the air outlet formed on the end of the duct lower 21. The second end of the reflector 27 extends along an inner circumference of the duct lower 21 to a portion connected to the duct connector 23. Accordingly, the shape deformation or melting of the duct lower 21 can be prevented in the course where the air heated by the heater 25 is introduced into the tub 15.

Unlike the heat seal seating groove 271, the sensor hole 272 is formed in a closed-curve shape. This will now be described in more detail.

A sealing member is disposed on the outer circumference of the over-heating preventing sensor 29. The sealing member may be formed of rubber. When the sealing member is damaged by heat, this may cover the over-heating preventing sensor 29. In this case, the heat detection may not be effectively realized. Therefore, in order to protect the over-heating preventing sensor 29 from the sealing member, the over-heating preventing sensor hole 272 is formed in the closed-curve shape so that only a detecting surface of the over-heating preventing sensor 29 can be exposed to the heat.

FIG. 11 is a sectional view taken along line II-II of FIG. 2 and FIG. 12 is an enlarged view of a portion C of FIG. 11.

Referring to FIGS. 11 and 12, as described above, the drying duct assembly 20 of the present invention includes the duct lower 21, the duct upper 22 coupled to the top of the duct lower 21, the reflector 27 seating on the inner circumference of the duct lower 21, and the heater bracket 26 seating on the upper portion of the reflector 27 to support the heater.

The duct lower 21 is provided at the bottom center with the heater bracket supporting portion 213 protruding upward. A concave portion 213*a* having a pre-determined diameter and depth is formed on the top surface of the heater bracket supporting portion 213. A coupling boss 213*b* extending from the concave portion 213*a* downward is formed. A coupling member 40 is inserted in the coupling boss 213*b*.

A heater bracket supporting portion 273 having a same shape as the heater bracket supporting portion 213 formed on the duct lower is also formed on the bottom of the reflector 27. A concave portion 273*a* is formed on the top surface of the heater bracket supporting portion 273 and a coupling hole 273*b* is formed on the center of the concave portion 273*a*. The coupling member 40 is inserted in the coupling hole 273*b*. The lower end 26 of the heater bracket 26 seats on the concave portion 273*a*.

As described above, a heat generation unit 253 is coupled to the upper portion of the heater bracket 26. The lower portion of the heater bracket 26 seats on the concave portion 273*a*. Therefore, even when the coupling member 40 is loosely tightened or removed from the coupling boss 213*b*, the separation of the heater bracket 26 from the heater bracket supporting portion 273 can be prevented. That is, the upper and lower ends of the heater bracket 26 are fixed by the heater 25 and the heater bracket supporting portion 273.

In addition, the coupling member 40 functions non only to fix heater bracket 26 to the duct lower 21 and the reflector 27 but also to fix the reflector 27 to the duct lower 21.

When the duct lower 22 is formed of the SPS through the injection molding process, a member such as the reflector 27 may be mounted on the inner circumference of the duct upper 22.

FIG. 13 is a view illustrating a coupling method of the reflector and the duct lower according to another embodiment of the present invention.

Referring to FIG. 13, a fixing projection protruding from a top surface of the duct lower 21 is provided.

The fixing projection 210*b* may be integrally formed with the duct lower through the injection molding process. One or more fixing projections 210*b* may be provided. A length of the fixing projection 210*b* may be slightly longer than that of the supporting rib 216. This will now be described in more detail.

The reflector 27 seats on the top surface of the duct lower 21 on which the fixing projection 210*b* is formed. Here, a hole through which the fixing projection 210*b* penetrates is formed on the bottom of the reflector 27. When the reflector 27 seats on the supporting rib 216, the fixing projection 210*b* is projected out of the reflector 27. The projected upper portion of the fixing projection 210*b* is molten to fix the top surface of the fixing projection 210*b* on the bottom surface of the reflector 27. Through the above-described process, the fixing projection 210*b* functions as the coupling member. When the projected upper portion of the fixing projection 210*b* is molten, it spreads in a radial direction to completely seal the fixing projection penetration hole formed on the reflector 27. Therefore, no nap is introduced through the hole and the gap between the reflector 27 and the duct lower 21.

FIG. 14 is an enlarged view of a portion D of FIG. 11.

Referring to FIG. 14, the reflector 27 is formed along an inner circumference of the duct lower 21 in a shape identical to the inner circumference of the duct lower 21.

That is, a side portion of the reflector 27 is longer than the side portion of the duct lower 21 to be projected above the top surface of the duct lower 21.

As shown in the drawing, a side upper end of the reflector 27 is higher than a side upper end of the duct lower 21 to guide the duct upper 22 to the right position. Since the side end portion of the reflector 27 extends to have a sufficient length, the damage of the duct seal 28 fitted on the top surface of the duct lower 21 by the high temperature air flowing in the drying duct assembly 20 can be prevented. The duct seal 28 is generally formed of rubber that is very weak against heat. Therefore, there is a need for means for preventing the duct seal 28 from being damaged by the high temperature air. The means is realized by properly adjusting the length of the side portion of the reflector 27.

Furthermore, since the side end portion of the reflector 27 is longer than the side end portion of the duct lower 21, the high temperature air leakage out of the drying duct assembly 20 can be prevented. That is, the air leakage prevention can be dually realized by the side end portion of the reflector 27 and the duct seal 28.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the above-described drying duct assembly, since the load of the drying duct assembly is reduced while the heat-resistance is enhanced, the manufacturing cost is reduced and the safety problem can be solved.

The invention claimed is:

1. A drying duct assembly, comprising:

a lower duct;

an upper duct coupled to an upper portion of the lower duct;

a reflector seated on one of inner circumferences of the lower duct and the upper duct;

a heater provided in the lower duct, that generates heat; and a fan assembly provided on a side of the lower duct that sucks air, wherein the reflector is spaced apart from an inner circumference of the lower duct by a predetermined gap, wherein an inside surface of the lower duct is stepped, and wherein an upper surface of the reflector is placed at a same plane as the stepped portion to prevent foreign objects from being introduced through the predetermined gap between the reflector and the lower duct.

2. The drying duct assembly according to claim 1, further comprising a duct connector connected to the lower duct.

3. The drying duct assembly according to claim 2, wherein one of the lower duct, the upper duct and the duct connector is formed of plastic or SPS by an injection molding process.

4. The drying duct assembly according to claim 1, wherein the reflector is formed of metal sheet coated with aluminum.

5. The drying duct assembly according to claim 1, further comprising a heater bracket that fixes the heater in the lower duct.

6. The drying duct assembly according to claim 5, wherein a supporting portion protrudes upward from a bottom of each of the reflector and the lower duct and a concaved portion is formed on a top surface of each of the supporting portions, wherein the heater bracket sits on the concaved portions.

7. The drying duct assembly according to claim 1, further comprising a spacing portion that is concave or convex provided on a bottom of the lower duct to space the reflector apart from the inner circumference of the lower duct.

8. The drying duct assembly according to claim 1, wherein, in order to prevent leakage of air sucked by the fan assembly through a gap between the upper duct and the lower duct, a side portion of the reflector extends higher than a side portion of the lower duct.

9. A drying duct assembly, comprising:

a lower duct;

an upper duct coupled to an upper portion of the lower duct to define an air passage therebetween;

a reflector seated on one of inner circumferences of the lower duct and the upper duct;

a heater that heats air introduced into the air passage;

a fan assembly provided on a fan seating portion, that intakes the air; and a duct connector connected to one of the lower duct and the upper duct that directs the air sucked by the fan assembly into a drum, wherein the reflector is spaced apart from an inner circumference of the lower duct by a predetermined gap, wherein an inside surface of the lower duct is stepped, and wherein an upper surface of the reflector is placed at a same plane as the stepped portion to prevent foreign objects from being introduced through the predetermined gap between the reflector and the lower duct.

10. The drying duct assembly according to claim 9, further comprising a coupling boss that extends from an edge of the lower duct, wherein a coupling member that couples the upper duct to the lower duct is inserted into the coupling boss.

11. The drying duct assembly according to claim 9, wherein the reflector covers all of the inner circumference of the lower duct except for the fan seating portion.

12. The drying duct assembly according to claim 9, wherein the fan assembly includes a drying fan, a fan motor, a motor housing configured to receive the fan motor, and a motor mount that mounts the fan motor to the motor housing.

13. The drying duct assembly according to claim 9, further comprising a heater bracket that supports the heater, wherein a supporting portion that supports the heater bracket protrudes from bottoms of each of the lower duct and the reflector.

14. The drying duct assembly according to claim 13, wherein a concaved portion is formed on a top surface of each of the supporting portions and the heater bracket sits on the concaved portions.

15. The drying duct assembly according to claim 13, further comprising a coupling boss that extends downward from at least one of the supporting portions, wherein the coupling member is inserted in the coupling boss after passing through the reflector.

16. The drying duct assembly according to claim 9, wherein a side portion of the reflector is longer than a side portion of the lower duct to guide the upper duct to a predetermined position with respect to the lower duct.

17. A drying duct assembly, comprising:

a lower duct around which a sealing member is installed, the lower duct being formed of plastic or SPS;

an upper duct that covers an upper portion of the lower duct;

a reflector formed of metal and seated on an inner circumference of the lower duct; and a heater provided in a space defined between the lower duct and the upper duct, wherein the reflector is spaced apart from the inner circumference of the lower duct by a predetermined gap, wherein an inside surface of the lower duct is stepped, and wherein an upper surface of the reflector is placed at a same plane as the stepped portion to prevent foreign objects from being introduced through the predetermined gap between the reflector and the lower duct.

18. The drying duct assembly according to claim 17, wherein the reflector is coated with aluminum.

19. The drying duct assembly according to claim 17, wherein a side portion of the reflector is longer than a side portion of the lower duct to prevent heat transfer to a sealing member and air leakage.

20. The drying duct assembly according to claim 16, wherein a spacing portion that is concave or convex is provided on a bottom of the lower duct to space the reflector apart from the inner circumference of the lower duct.

21. The drying duct assembly according to claim 16, wherein a supporting rib or supporting boss is formed on a bottom of the lower duct to space the reflector apart from the lower duct.

22. A drying duct assembly, comprising:

an upper duct and a lower duct formed of plastic or SPS;

a heater disposed in a space defined between the upper duct and the lower duct;

a reflector provided between the lower duct and the heater; and a spacer that spaces the reflector apart from the lower duct, wherein an inside surface of the lower duct is stepped, and wherein an upper surface of the reflector is placed at a same plane as the stepped portion to prevent foreign objects from being introduced through a gap between the reflector and the lower duct.

23. The drying duct assembly according to claim 22, wherein the spacer is continuously or discontinuously formed on the reflector or an inner circumference of the lower duct.

24. The drying duct assembly according to claim 22, wherein the spacer is a rib or boss that protrudes from a bottom of the lower duct.

25. The drying duct assembly according to claim 22, wherein the spacer is concave and protrudes downward from a portion of the reflector.

26. The drying duct assembly according to claim 25, wherein the spacer is formed during a forming process of the reflector.

27. The drying duct assembly according to claim 22, further comprising a fixing boss that protrudes from an inner circumference of the lower duct, passes through the reflector, and fixes the reflector to the lower duct.

28. The drying duct assembly according to claim 27, wherein an upper end portion of the fixing boss, which projects out of the reflector, is fixed to the lower duct by a thermal-bonding process.

29. A drying duct assembly, comprising:

a lower duct having a fan seating portion provided at a first end and a stepped portion formed on an inner circumference thereof;

an upper duct that covers the lower duct to define an air passage therebetween;

a reflector provided between the lower duct and the upper duct and being spaced from the inner circumference of the lower duct by a predetermined gap, the reflector having a first end that contacts the stepped portion; and a fan assembly seated on the fan seating portion, wherein an upper surface of the reflector is placed at a same plane as the stepped portion to prevent foreign objects from being introduced through the predetermined gap between the reflector and the lower duct.

30. The drying duct assembly according to claim 29, wherein the stepped portion is formed to be a predetermined distance apart from the fan seating portion.

31. The drying duct assembly according to claim 29, further comprising a spacer that protrudes from the inner circumference of the lower duct, the spacer being concaved from a portion of the reflector.

32. The drying duct assembly according to claim 29, further comprising:

a sensor that detects an inside of the air passage is overheated;

a sealing member disposed around an outer circumference of the sensor;

an insertion groove formed on a side of the lower duct configured to receive the sealing member; and a sensor hole formed on a side of the reflector to expose only a sensing portion of the sensor.

33. A washing machine, comprising:

a drum configured to receive laundry loaded therein;

a tub that receives the drum;

a drying duct assembly provided on an outer side of the tub that supplies hot air into the drum; and a condensing duct connected to the tub, wherein damp air exhausted from the tub flows along the condensing duct, and wherein the drying duct assembly comprises:

an upper duct and a lower duct formed of plastic or SPS;

a heater disposed in an air passage defined between the upper duct and the lower duct;

a reflector provided between the lower duct and the heater, the reflector being formed of metal;

a spacer that spaces the reflector apart from the lower duct; and a fan assembly that sucks in outer air and directs the sucked air to the tub, wherein a stepped portion is formed on an inside surface of the lower duct, and wherein an upper surface of the reflector is placed at a same plane as the stepped portion to prevent foreign objects from being introduced between the reflector and the lower duct.

34. The washing machine according to claim 33, further comprising a duct connector connected to an end of the lower duct that directs the hot air into the tub.

35. The washing machine according to claim 33, wherein the reflector is formed of metal sheet coated with aluminum.

36. The washing machine according to claim 33, further comprising a heater bracket that fixes the heater in the lower duct, wherein a supporting portion protrudes from a portion of the inside bottom of the lower duct and a concave portion is formed on the supporting portion to which the heater bracket is fixed.

37. The washing machine according to claim 33, wherein the spacer is one of a rib or boss that protrudes from the inside bottom of the lower duct or a concaved portion formed on the reflector.

38. The washing machine according to claim 33, wherein, in order to prevent leakage of air sucked by the fan assembly, a side portion of the reflector extends higher than a side portion of the lower duct.

39. The washing machine according to claim 33, further comprising a guide boss formed on an edge of the lower duct that guides the coupling of the upper duct to the lower duct.

40. The washing machine according to claim 33, further comprising a fixing boss formed on an inner circumference of the lower duct that passes through the reflector to be thermally-bonded thereto.

41. The washing machine according to claim 33, further comprising:

a sensor that detects if an inside of the air passage is over-heated;

a sealing member disposed around an outer circumference of the sensor;

an insertion groove formed on a side of the lower duct configured to receive the sealing member; and a sensor hole formed on a side of the reflector to expose only a sensing portion of the sensor.

* * * * *